United States Patent [19]

Hueter et al.

[11] 4,229,892

[45] Oct. 28, 1980

[54] DISPLAY DEVICE

[75] Inventors: O. William Hueter, 2970 Airport Hwy., Toledo, Ohio 43609; Richard A. Gross, Perrysburg, Ohio

[73] Assignee: O. William Hueter, Toledo, Ohio

[21] Appl. No.: 6,089

[22] Filed: Jan. 24, 1979

[51] Int. Cl.[3] ..... G09F 1/12

[52] U.S. Cl. ..... 40/152.1; 40/155; 248/470

[58] Field of Search ..... 40/152.1, 152, 154, 40/158 R, 155; 248/460, 470

[56] References Cited

U.S. PATENT DOCUMENTS

| | | | |
|---|---|---|---|
| Re. 22,683 | 10/1945 | Piper | 40/152.1 |
| 527,694 | 10/1894 | Jones | 40/152.1 UX |
| 1,159,735 | 11/1915 | Beers | 40/152.1 |
| 1,815,436 | 7/1931 | Harris | 40/152.1 |
| 2,047,075 | 7/1936 | Kremen | 248/470 X |
| 2,419,823 | 4/1947 | Cross et al. | 40/152.1 |
| 2,450,495 | 10/1948 | Ullmann | 40/152.1 |
| 2,456,720 | 12/1948 | Miles | 40/152.1 |
| 2,758,402 | 8/1956 | Fulmer | 40/152.1 |
| 3,065,943 | 11/1962 | Hull | 248/441 |
| 3,186,117 | 6/1965 | Detje | 40/152.1 |
| 3,471,959 | 10/1969 | Seger | 40/152 |
| 3,680,239 | 8/1972 | Andrews | 40/152.1 |
| 3,837,987 | 9/1974 | Williams et al. | 40/152.1 |
| 3,908,955 | 9/1975 | Frechtman | 248/470 |

FOREIGN PATENT DOCUMENTS

| | | | |
|---|---|---|---|
| 893829 | 11/1944 | France | 40/152.1 |
| 237596 | 9/1945 | Switzerland | 40/152.1 |
| 252961 | 10/1948 | Switzerland | 40/152.1 |

*Primary Examiner*—John F. Pitrelli
*Assistant Examiner*—G. Lee Skillington
*Attorney, Agent, or Firm*—Wilson, Fraser, Barker & Clemens

[57] ABSTRACT

A display device, such as a photo mount, having a frame holder and a support member is disclosed. The frame holder includes an open front frame, a complementary shaped back panel, a spacer element therebetween to form a pocket for the article to be displayed, and an adapter. The frame holder may be hung along either longitudinal axis using the adapter. The display device may also be supported as a free standing element by engaging the support member to the adapter. The support member is fabricated from a fatigue resistant material and is removably secured to the adapter.

12 Claims, 9 Drawing Figures

DISPLAY DEVICE

BACKGROUND OF THE INVENTION

1. Field of the Invention

The present invention relates to a display device, such as a photo mount or document holder. Such display devices typically include a rectangular backing panel, a complementary shaped open front frame, and a spacer element therebetween extending along three sides of the rectangle leaving an open slot extending into the pocket formed by the front frame, the backing panel, and the spacer element. One disadvantage of the prior art is the difficulty in mass producing the mounts and in attaching a folding foot of conventional design to the rear surface of the backing panel.

2. Description of the Prior Art

U.S. Pat. No. 2,450,495 discloses an easel arrangement which includes an easel support member having a head portion insertable into a receiving latch member. The latch member is molded to be integral with the back of the frame assembly and has entrance openings at right angles to each other so that the head portion of the easel support member may be selectively inserted therein to determine the desired positioning of the frame. The device is also provided with recesses for hanging the structure on a wall in either of two positions.

U.S. Pat. No. 3,837,987 discloses a document holder having a folding support foot. The foot is fabricated from a fatigue resistant material and is secured to the back panel by a bridge piece fabricated from a material compatible for bonding with the back panel. The prior art discussed above poses several problems of design and production which are readily apparent.

SUMMARY OF THE INVENTION

It is an object of the present invention to provide an inexpensive and easily mass produced display device which eliminates the disadvantages attendant with prior art frames of this nature. This object is attained by a unique adapter element secured to the rear surface of the display device. The adapter element has apertures formed therein to allow the display device to be hung on a wall along either of its major axes. The display device may also be used as a free standing element, such as on a table or desk top, by inserting one end of a support member into a tab receiving slot in the adapter. This mode allows either major axis to be placed in the horizontal position.

BRIEF DESCRIPTION OF THE DRAWINGS

Other objects and advantages of the invention will be apparent to those skilled in the art from the following detailed description of the invention, when considered in the light of the accompanying drawings in which.

DETAILED DESCRIPTION OF THE INVENTION

Figure 1:
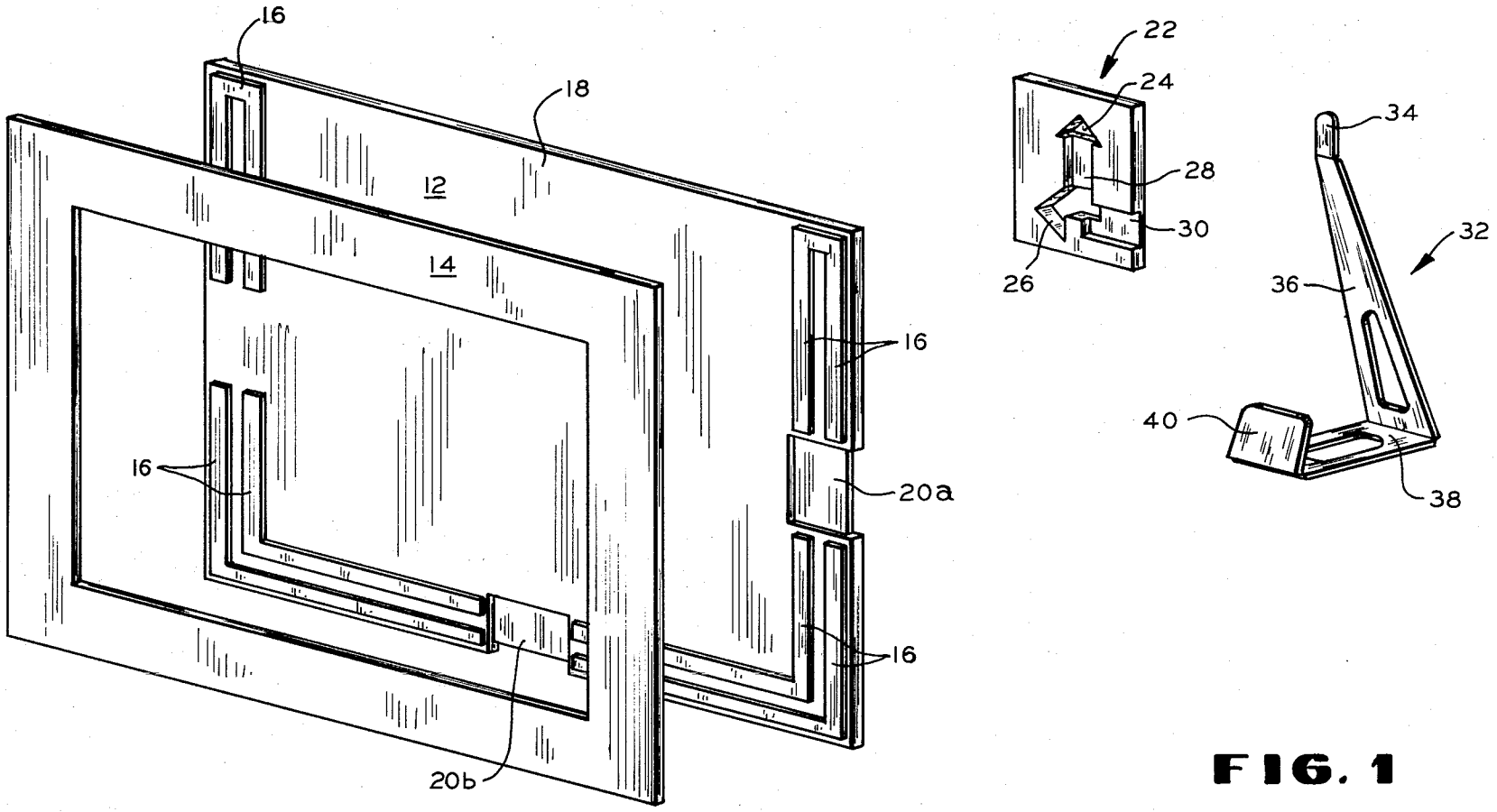
FIG. 1 is an exploded perspective view of a display device incorporating the features of the present invention.

Referring to FIGS. 1 through 6, there is illustrated a display device which includes a back panel 12 and a front frame 14. The front frame 14 defines a display area of an enclosed article, which is typically a picture or document, and may have a wood grain or other decorative effect applied to its outwardly face. The height and width of the front frame 14 may vary with the size and shape of the article to be displayed, but generally the major axes of the display device will be orthogonal to one another.

It will be noted that the outer peripheral edges of the back panel 12 and the front frame 14 are substantially coextensive. The back panel 12 is provided with a plurality of raised ribs 16 extending along three of its marginal edges such that when the front frame 14 is placed over the back panel 12 in a manner causing the respective marginal edges to coincide, the plurality of ribs 16 contact only the inner surface of the front frame 14 in FIG. 2. In the centers of two adjacent edges of the inner surface 18 of the back panel 12 are formed tab receiving chambers 20*a* and 20*b* to be used when the display device is in the free standing mode described below.

The front frame 14 and the back panel 12 are typically secured together with a suitable adhesive. The plurality of ribs 16 act as spacers between the front frame 14 and the back panel 12. The thickness of the plurality of ribs 16 should be such that the pocket formed by the front frame 14, the back panel 12, and the plurality of ribs 16 is sufficiently wide to receive the articles or document to be displayed, but not so excessively great as to allow the article to wrinkle or curl within.

Figure 2:
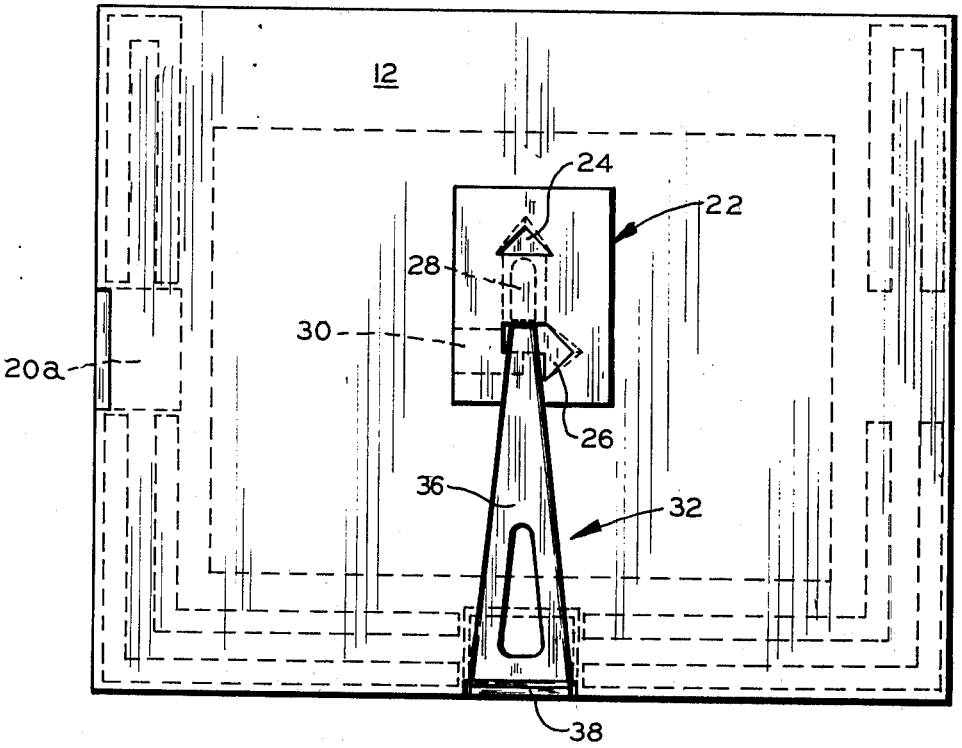
FIG. 2 is a rear elevational view of the assembled device illustrated in FIG. 1.
Figure 3:
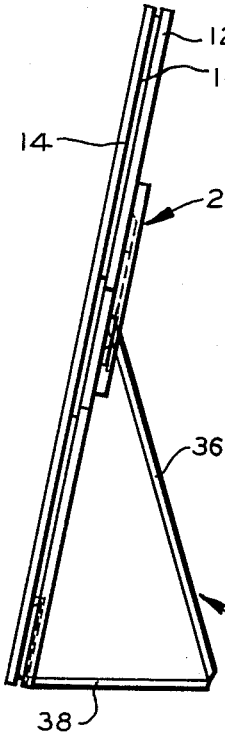
FIG. 3 is a side elevational view of the device illustrated in FIG. 2.
Figure 4:
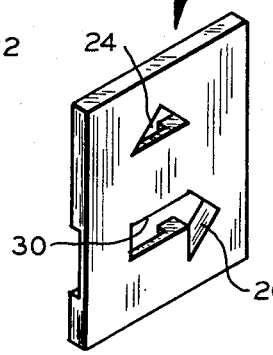
FIG. 4 is a perspective view of the adapter element illustrated in FIGS. 1, 2, and 3.

The rear surface of the back panel 12 is provided with an adapter element 22. The adapter element 22, clearly illustrated in FIGS. 1 and 4, is typically secured to the back panel 12 with a suitable adhesive. The adapter element 22 includes a pair of V-shaped apertures 24 and 26 and a pair of slots 28 and 30 formed in the material. The adapter element 22 should be oriented such that each of the slots 28 and 30 opens towards and is axially aligned with a respective tab receiving chamber 20*a* or 20*b* in the back panel 12, as illustrated in FIG. 2. The aperture 24 may be used to hang the display device so that one of its major axes will be in a generally horizontal position. The aperture 26 may be used to hang the display device so that the other of its major axes will be in a generally horizontal position. Any suitable means for hanging the display device, such as a nail or hook, may be used for support so that the selected aperture 24 or 26 receives the nail or hook and engages it securely in the apex of the V-shaped section to properly orient the device. Thus, the display device may be securely supported in either of the above hanging modes.

The display device may also be employed as a free standing element, such as commonly found on a table or desk top. For this mode, a support member 32 is utilized. The support member 32 consists of an upper tab 34, a strut 36, a foot 38, and a lower tab 40, each section being connected to the adjacent section by a webbed hinge clearly illustrated in FIGS. 5 and 6 and well known to those skilled in the art. The display device may be arranged for the free standing mode by inserting the upper tab 34 of the support member 32 into the desired slot of the adapter element 22 for example, slot 28. The lower tab 40 of the support member 32 is inserted into the corresponding and axially aligned tab receiving chamber 20*b* in the back panel 12. Likewise, if the other axis is desired to be placed in the horizontal position, the upper tab 34 is inserted into slot 30 of the adapter element 22, and the corresponding tab receiving chamber 20*a* receives the lower tab 40. Thus, the display device may be hung or stood upon either of its major axes.

The front frame 14, the back panel 12, and the adapter element 22 may be preferably fabricated from inexpensive thermoplastic materials, such as polystyrene, while the support member 32, because of the nature of its intended function, is typically fabricated from a fatigue resistant material, such as polypropylene or high density polyethylene. Conventional adhesives or thermal autogenous bonding methods may be used to attach the front frame 14 and the adapter element 22 to the back panel 12. The support member 32 is removably secured to the display device, thus eliminating the problems attendant with the use of adhesives or other bonding methods on non-similar materials.

Figure 7:
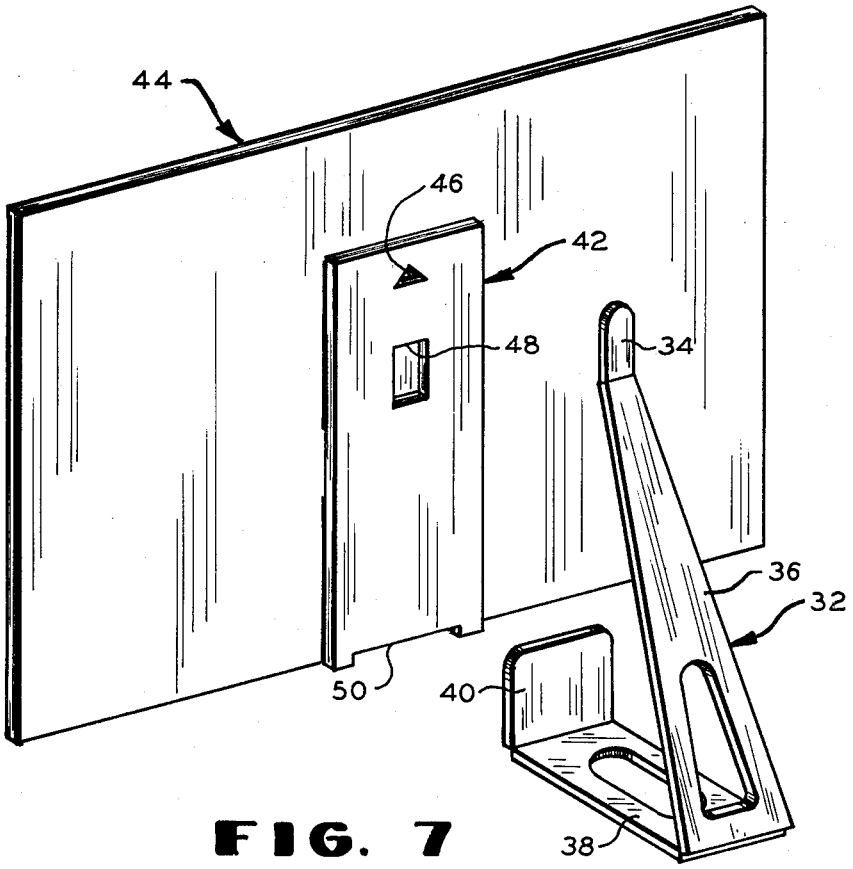
FIG. 7 is an exploded perspective view of a display device utilizing an alternate embodiment of the adapter element.
Figure 8:
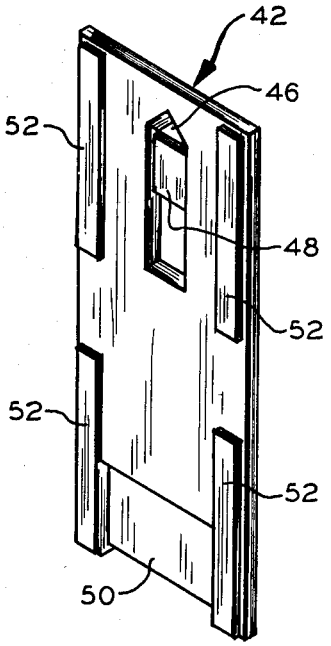
FIG. 8 is a perspective view of the adapter element illustrated in FIG. 7.
Figure 9:
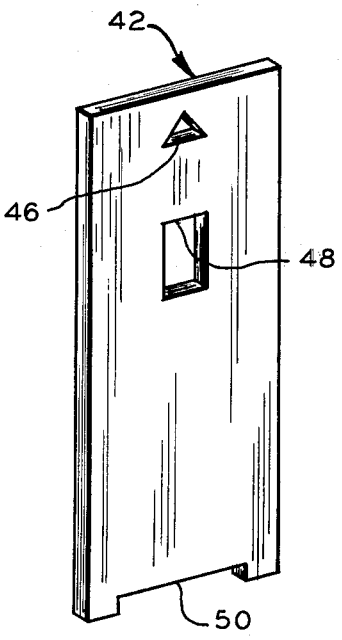
FIG. 9 is another perspective view of the adapter element illustrated in FIGS. 7 and 8.

Referring to FIGS. 7 through 9, there is illustrated a display device which includes an alternate embodiment of an adapter element 42. The adapter element 42 is typically secured to the rear surface of a panel 44. The panel 44 may typically be a plaque having indicia on the front surface which is to be displayed. As will be discussed, the adapter element 42 permits the panel 44 to be displayed in either the hanging mode or in the free standing mode.

The adapter element 42, clearly illustrated in FIGS. 8 and 9, includes a V-shaped aperture 46 and a slot 48 formed in the main body portion thereof, and a tab receiving chamber 50 formed in the peripheral edge portion thereof.

The adapter element 42 also includes a plurality of spaced apart parallel ribbed elements 52 formed on the one surface of the adapter element 42 which is to be secured to the rear surface of the panel 44. The ribbed elements 52 function to space the adapter element 42 away from the panel 44 such that the rear surface of the panel 44 cooperates with the adapter element 42 to provide the slot 48 and the chamber 50 with dimensions suitable for receiving the respective tabs of the support member 32. The ribbed elements 52 also provide clearly defined surface areas to which a suitable adhesive can be applied for securing the adapter element 42 to the rear surface of the panel 44.

The adapter element 42 is typically positioned on the rear surface of the panel such that the tab receiving chamber 50 is located along the lower marginal edge of the panel 44. Thus, if the panel 44 is to be displayed in the hanging mode, a suitable hook means may be used to engage the apex of the V-shaped section of the aperture 46 such that the front surface of the panel 44 is properly oriented.

Figure 5:
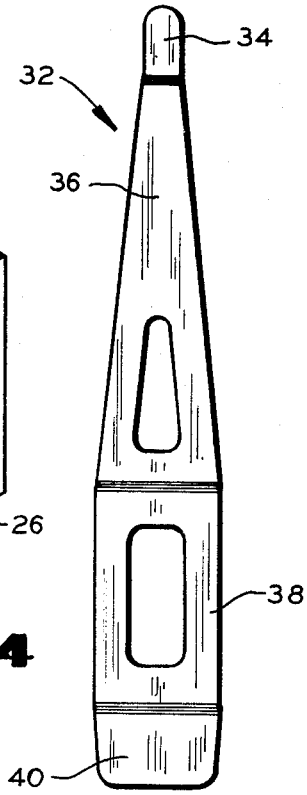
FIG. 5 is a plan view of the support member illustrated in FIGS. 1, 2, and 3.
Figure 6:
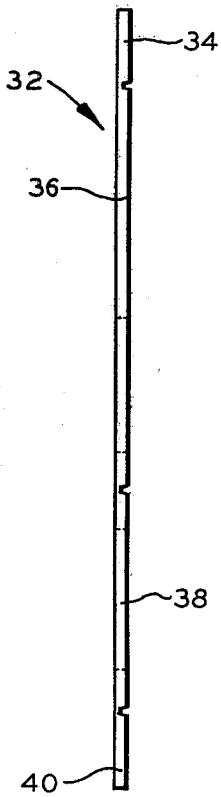
FIG. 6 is a side elevational view of the support member shown in FIG. 5.

If the panel 44 is to be displayed in the free standing mode, the support member 32 illustrated in FIGS. 5 and 6 is utilized. The upper tab 34 of the support member 32 is inserted into the slot 48 while the lower tab 40 is inserted into the tab receiving chamber 50. Thus, the display device may be employed as a free standing element on a desk or table top, for example.

One of the inherent advantages of the adapter element 42 is that the tab receiving chamber 50 for receiving the lower tab of the support member 32 is an integral portion thereof. This structure thus eliminates the need for forming a tab receiving chamber in the marginal edge of the attendant panel. Thus, the adapter element 42 can easily be utilized for displaying a single panel article such as a plaque.

The adapter element 42 and the panel 44 may be preferably fabricated from relatively inexpensive thermoplastic materials, such as polystyrene. Conventional adhesives or thermal autogenous bonding methods may be utilized to attach the adapter element 42 to the panel 44.

It will be seen from the above detailed description of the preferred embodiment that the present invention provides an inexpensive photo mount or other document holder with a unique hanging and support means which eliminates many disadvantages of the prior art described above. It will also be seen that the advantages of the present invention may be used with frame shapes other than rectangular, such as oval or round shapes or other desired geometries. Various other advantages of the present invention will be apparent to those skilled in the art and various modifications may be made without departing from the scope and spirit of the attached claims.

What I claim is:

1. A display device comprising:

a panel having an outer periphery and front and rear planar surfaces;

a tab receiving chamber formed along the marginal edge portion of said panel;

an adapter element attached to the rear planar surface of said panel and having at least one aperture formed therein for receiving a suitable hook for hanging the panel with one of its axes in generally horizontal position and having at least one slot formed therein; and a support member having an upper tab insertable into the slot in said adapter element and a lower tab insertable into the tab receiving chamber formed along the marginal edge of said panel, said support member including a foot portion attached to the lower tab and extending away from the rear surface of said panel defining a lower planar surface for supporting the panel in a free standing mode on a supporting planar surface, wherein the planar surface of the foot is adapted to be on the plane of the supporting surface.

2. A display device according to claim 1 wherein said tab receiving chamber is formed by said adapter element and the cooperating rear surface of said panel.

3. A display device according to claim 1 wherein said tab receiving chamber is formed in the marginal edge portion of said panel.

4. A display device according to claim 3 wherein said adapter element includes a second aperture formed therein for receiving a suitable hook for hanging the panel with an axis normal to said one axis in a generally horizontal position.

5. A display device according to claim 3 wherein said adapter element includes a second slot formed therein and said panel includes a second tab receiving chamber formed therein such that the upper tab of said support member is insertable into the second slot of said adapter element and the lower tab of said support member is insertable into the second tab receiving chamber of said panel for supporting the panel in a free standing mode.

6. A display device according to claim 1 wherein said panel has a front frame member attached in a spaced relation to said panel and the front frame member includes an interior opening to display an enclosed article and an outer periphery shaped generally to coincide with the outer periphery of said panel.

7. A display device according to claim 6 wherein the spaced relation between said panel and the front frame member is a plurality of ribs extending along three marginal edges of said panel.

8. A display device according to claim 1 wherein said panel and said adapter element are formed of a thermoplastic material.

9. A display device according to claim 8 wherein the thermoplastic material is polystyrene.

10. A display device according to claim 1 wherein said support member is formed of a fatigue resistant material.

11. A display device according to claim 10 wherein said fatigue resistant material is polypropylene.

12. A display device according to claim 10 wherein said fatigue resistant material is high density polyethylene.

* * * * *